US012471726B1

(12) United States Patent
Burton-Madden et al.

(10) Patent No.: US 12,471,726 B1
(45) Date of Patent: Nov. 18, 2025

(54) LIQUID CONSUMPTION TRACKING DEVICE AND METHOD OF USE

(71) Applicants: Merkieann Burton-Madden, McKinney, TX (US); Damian Madden, McKinney, TX (US)

(72) Inventors: Merkieann Burton-Madden, McKinney, TX (US); Damian Madden, McKinney, TX (US)

(73) Assignee: Merkieann Burton-Madden and Damian Madden, McKinney, TX (US)

( * ) Notice: Subject to any disclaimer, the term of this patent is extended or adjusted under 35 U.S.C. 154(b) by 79 days.

(21) Appl. No.: 18/098,571

(22) Filed: Jan. 18, 2023

Related U.S. Application Data

(63) Continuation of application No. 17/744,232, filed on May 13, 2022, now abandoned.

(51) Int. Cl.
*A47G 23/16* (2006.01)

(52) U.S. Cl.
CPC ..... *A47G 23/16* (2013.01)

(58) Field of Classification Search
CPC ..... A47G 23/16
USPC ..... 215/230, 365; 40/310
See application file for complete search history.

(56) References Cited

U.S. PATENT DOCUMENTS 3,392,468 A * 7/1968 Wolf ..... G09F 3/00 116/307
4,722,451 A * 2/1988 Conrad ..... B65D 79/02 220/DIG. 16
6,206,229 B1 * 3/2001 Harjes ..... B65D 1/265 229/404
6,523,688 B1 * 2/2003 Palmieri ..... A47G 23/16 40/310
6,938,768 B2 * 9/2005 Ferretti ..... B65D 43/0212 215/230
6,951,353 B2 * 10/2005 Kozlowski ..... A61J 1/035 40/310
7,083,103 B2 * 8/2006 Hull ..... G06Q 30/02 235/487
7,121,550 B1 * 10/2006 Lo ..... A63F 3/00157 273/292
8,613,369 B2 * 12/2013 Kitto ..... B65D 55/16 215/390
9,855,193 B2 * 1/2018 O'Doherty ..... A61J 7/04
D876,978 S * 3/2020 McCarthy ..... D11/4
D927,329 S * 8/2021 Cadwell ..... D10/46.1
D973,791 S * 12/2022 Deng ..... D21/574
2007/0062277 A1 * 3/2007 Miller ..... A47G 23/14 73/426
2009/0064920 A1 * 3/2009 Duer ..... A61J 7/04 116/324
2009/0289026 A1 * 11/2009 Ferrara ..... B65D 51/245 215/230
2014/0014027 A1 * 1/2014 Bischoff ..... G09F 11/04 116/309

(Continued)

*Primary Examiner* — Orlando E Aviles
*Assistant Examiner* — Niki M Eloshway

(57) ABSTRACT

A liquid consumption tracking device for improving user convenience of tracking liquid consumption is disclosed. The liquid consumption tracking device includes housing with opposing ends; a flexible band portion with opposing ends; and a plurality of substantially spherical members, the plurality of substantially spherical members configured to be reversibly collapsible within the housing when pressed-on by a user's thumb or finger.

2 Claims, 5 Drawing Sheets

(56) References Cited

U.S. PATENT DOCUMENTS

| | | | | |
|---|---|---|---|---|
| 2014/0372045 | A1* | 12/2014 | Keski-Pukkila | A61B 5/742 702/19 |
| 2017/0178535 | A1* | 6/2017 | Vignola | G09B 19/0092 |
| 2020/0188233 | A1* | 6/2020 | Taylor | A61J 7/0409 |
| 2022/0023150 | A1* | 1/2022 | Taylor | A61J 7/04 |

* cited by examiner

LIQUID CONSUMPTION TRACKING DEVICE AND METHOD OF USE

CROSS REFERENCE TO RELATED APPLICATIONS

This application is a continuation of U.S. application Ser. No. 17/744,232, filed May 13, 2022, of which is hereby incorporated by reference in its entirety.

BACKGROUND

1. Field of the Invention

The present invention relates generally to liquid consumption tracking, and more specifically to a liquid consumption tracking device for monitoring a user's liquid intake from their preferred liquid container.

2. Description of Related Art

Hydration is essential for maintaining the body's ability to function properly. Such vital functions include regulating body temperature, delivering nutrients to cells, keeping joints and cartilage lubricated, as well as fighting infections. Today, many individuals track their liquid intake to ensure proper hydration. Various methods of liquid consumption tracking have been proposed such as inscribing measurements on containers, using gallon-sized bottles, and incorporating sensors into caps.

Although reasonably adequate, such methods of liquid consumption tracking are not free of limitations. For example, it is easy to lose track of the number of times a container is refilled, especially for smaller sized containers. In addition, larger sized containers are cumbersome to carry due to their weight and size, thereby limiting its portability. Methods employing sensors often require the sensor to be used on a specific container, which users may find unaesthetically pleasing.

Accordingly, it is an object of the present invention to provide a liquid consumption device that addresses the limitations discussed above.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
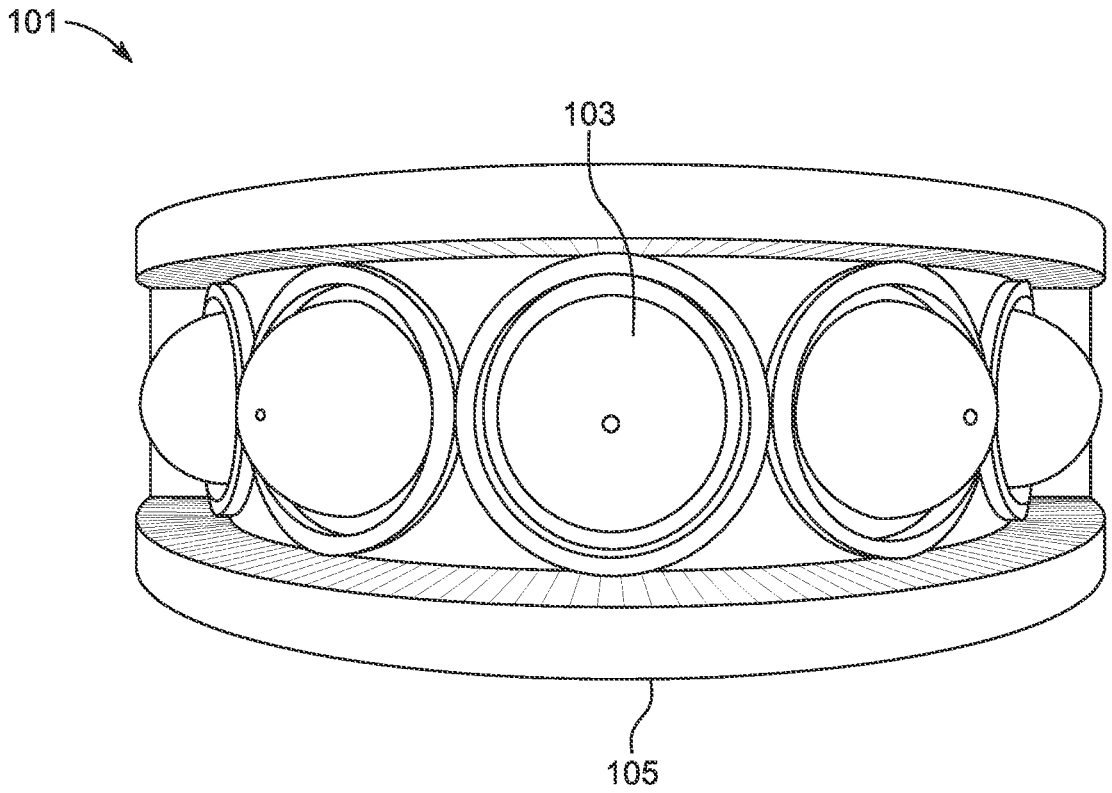
FIG. 1A is a front view of a liquid consumption tracking device in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional methods for liquid consumption tracking. Specifically, the present invention enables users to place a liquid consumption tracking device on their preferred liquid container, thereby improving user convenience. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
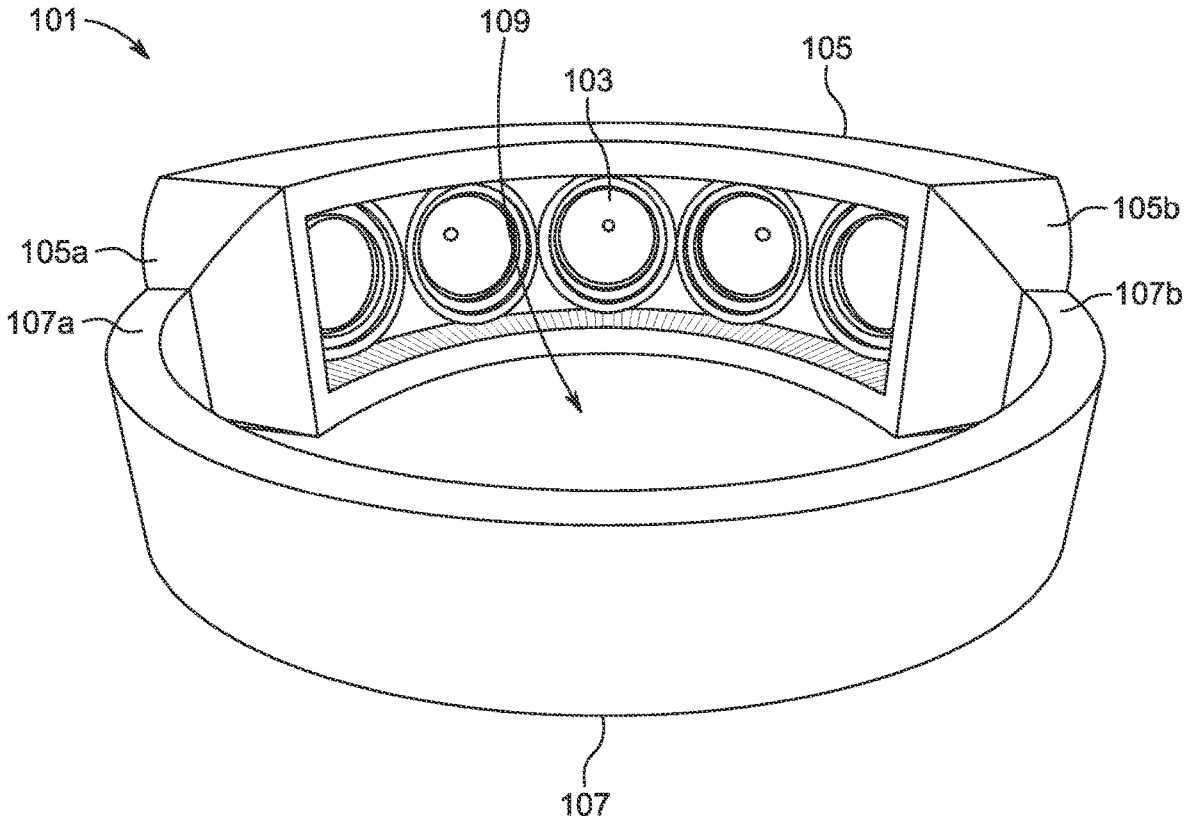
FIG. 1B is a rear perspective view of the liquid consumption tracking device of FIG. 1A.
Figure 1C:
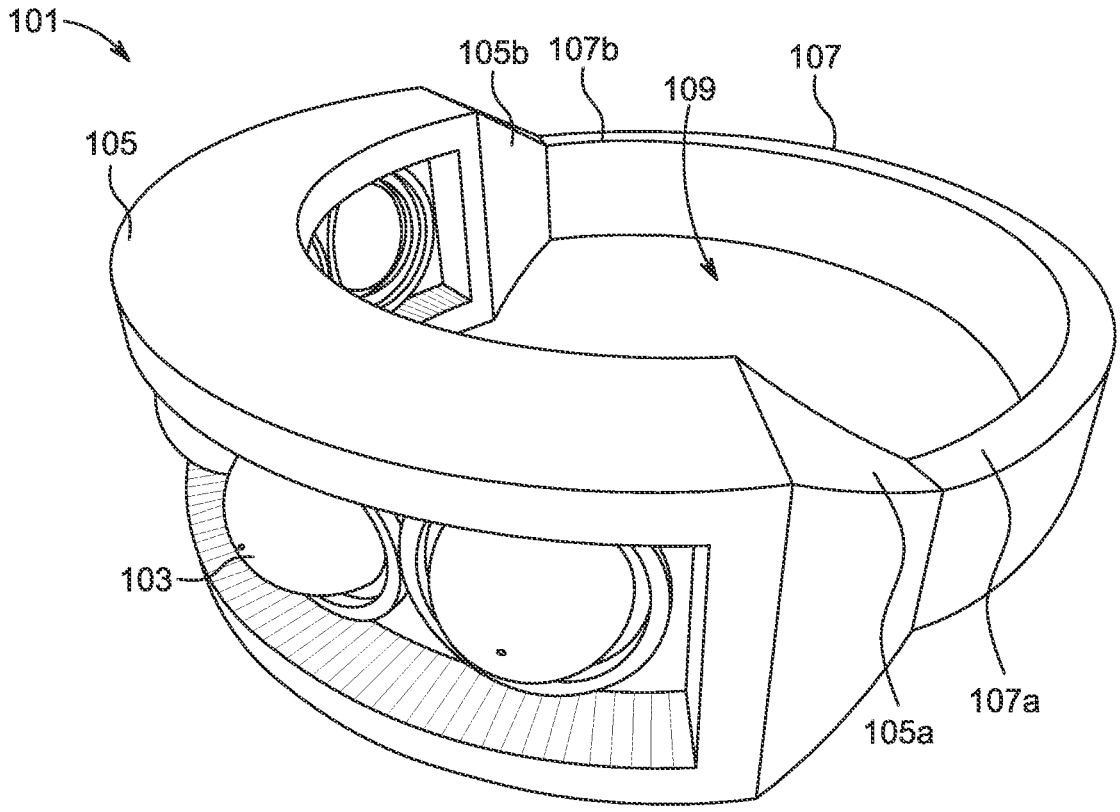
FIG. 1C is a top perspective view of the liquid consumption tracking device of FIG. 1A.

Referring now to the drawings wherein like reference characters identify corresponding or similar elements throughout the several views, FIGS. 1A through 1C depict various views of a liquid consumption tracking device 101 in accordance with a preferred embodiment of the present application. It will be appreciated that the liquid consumption tracking device 101 overcomes one or more of the above-listed problems commonly associated with conventional methods for liquid consumption tracking.

In the contemplated embodiment, the liquid consumption tracking device 101 includes a plurality of substantially spherical members 103 (preferably five spherical members)

disposed within a housing 105 having opposing ends 105*a*, 105*b*, and a flexible band portion 107 having opposing ends 107*a*, 107*b*. Opposing ends 105*a*, 105*b* engage with opposing ends 107*a*, 107*b*, respectively, to form a circular or oval orifice 109 so that a liquid container can be inserted therethrough. Opposing ends 105*a*, 105*b* may be removably coupled to, fixedly coupled to, or integrally formed with opposing ends 107*a*, 107*b*, respectively. Likewise, the housing 105 may be removably coupled to, fixedly coupled to, or integrally formed with the flexible band portion 107.

The spherical members 103 are configured to be collapsible within the housing 105 when pressed-on or "popped" by the user's thumb or finger. In the preferred embodiment, the liquid consumption tracking device 101 is reversible, thereby allowing the user to press-on or "pop" the spherical members 103 in the opposite direction.

In some embodiments, the spherical members 103 can be numerically labeled at opposing ends according to the number of spherical members disposed within the housing 105. For example, the first ends of the spherical members 103 may have numbers 1, 2, 3, 4 or 5 labeled thereon and their second ends may have numbers 6, 7, 8, 9 or 10 labeled thereon, respectively, thereby allowing the user to track up to 10 refills per liquid consumption tracking device 101.

In the preferred embodiment, the flexible band portion 107 is made of flexible material suitable to enable stretch. Examples of flexible material may include, without limitation, thermoplastic elastomer, silicone material, or the like.

In some embodiments, the liquid consumption tracking device 101 can include additional, different, and/or fewer components based on aesthetical, functional, or manufacturing considerations. As an example, the liquid consumption tracking device 101 may include a collapsible mechanism which allows the spherical members 103 to be collapsed within the housing 105. In another example, the flexible band portion 107 may be eliminated and the opposing ends 105*a*, 105*b* of the housing 105 may engage to form the circular or oval orifice 109, wherein the housing 105 is magnetic, thereby enabling the liquid consumption tracking device 101 to magnetically engage with a metal liquid container.

Figure 2:
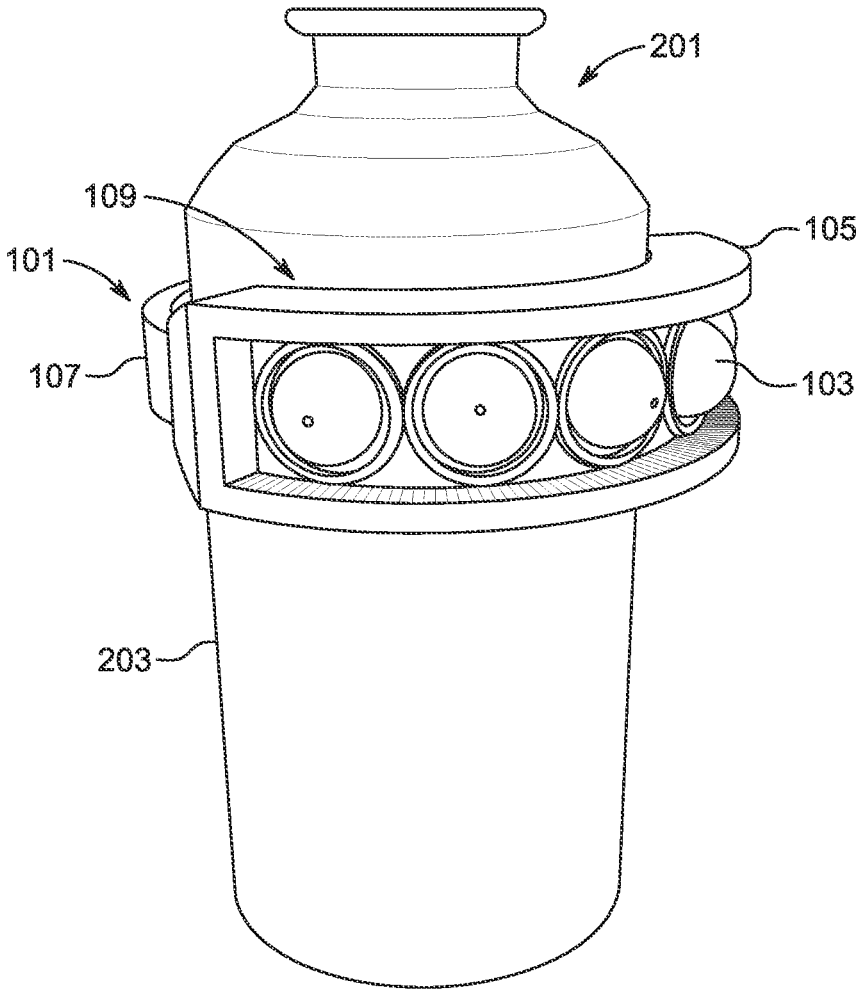
FIG. 2 is a front perspective view of a liquid container inserted into the liquid consumption tracking device of FIGS. 1A through 1C.

In FIG. 2, a front perspective view of a liquid container 201 inserted into the liquid consumption tracking device 101 is illustrated. As shown, the orifice 109 wraps around the body 203 of the liquid container 201.

It should be appreciated that during use, the user can insert their preferred liquid container through the orifice 109 of the liquid consumption tracking device 101. The liquid container can be made of a variety of shapes and sizes. In addition, the user can place multiple liquid consumption tracking devices on a single liquid container to increase the liquid tracking limit.

It should also be appreciated that one of the unique features believed characteristic of the present application is the poppable or collapsible nature of the spherical members 103 through tactile means which eliminates the need for a power source.

Figure 3:
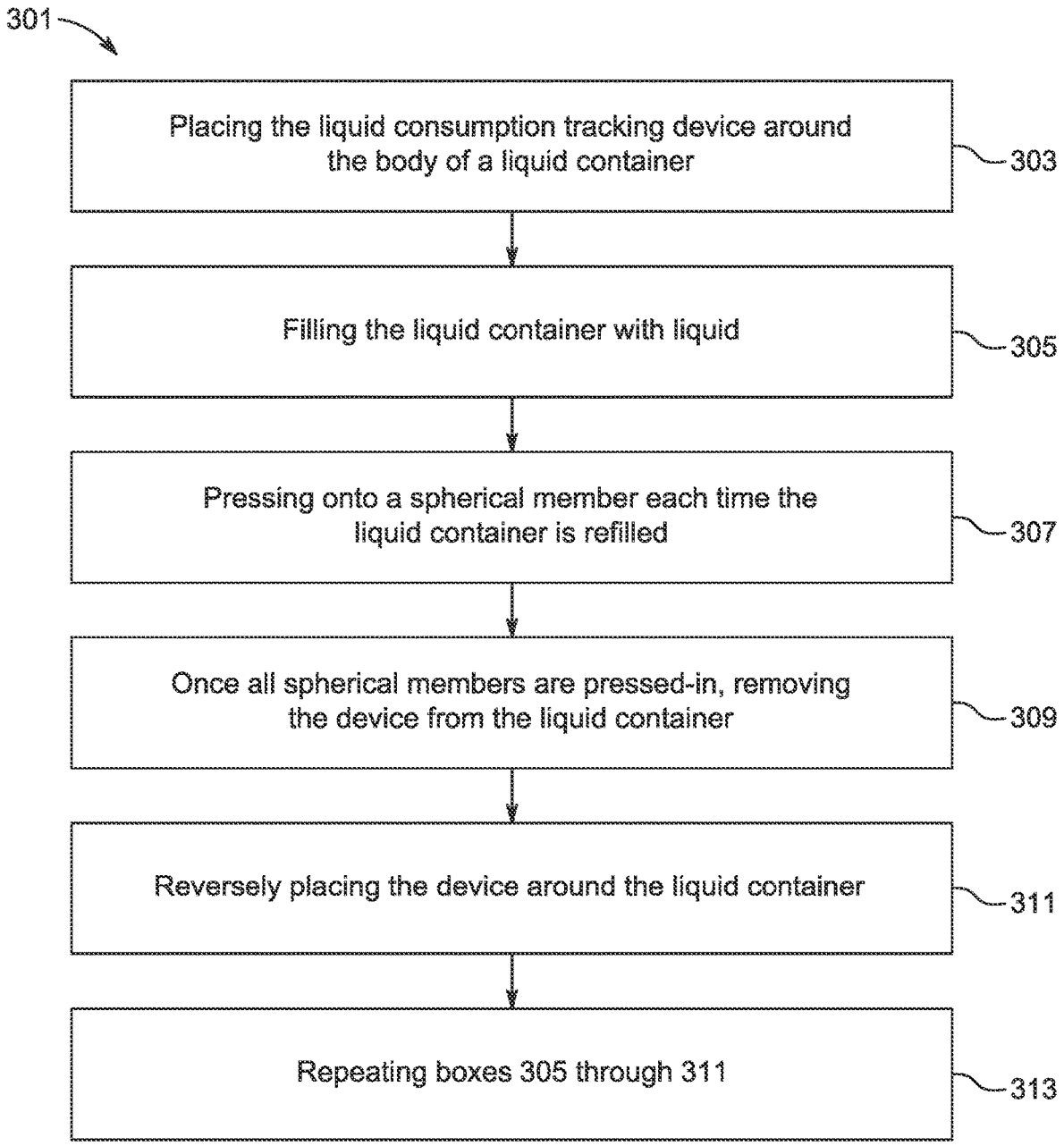
FIG. 3 is a flowchart of a method of use of the liquid consumption tracking device of FIGS. 1A through 1C.

In FIG. 3, a flowchart 301 depicts a simplified method of use associated with system 101. During use, the liquid consumption tracking device is placed around the body of a liquid container and the liquid container is filled with liquid, as shown with boxes 303, 305. A spherical member is pressed each time the liquid container is refilled, as shown with box 307. Once all spherical members are pressed-in, the liquid consumption tracking device is removed from the liquid container, as shown with box 309. The liquid consumption tracking device can be inverted or flipped such that the surface that previously contacted the container is repositioned to face outwardly and the opposite surface is placed against the container around the liquid container, as shown with box 311. The user may then continue to refill the liquid container and track liquid consumption from boxes 305 through 311 as desired, as shown with box 313.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A liquid consumption tracking device, comprising:

a housing having opposing ends;

a flexible band portion having opposing ends wherein the opposing ends of the housing engage with the opposing ends of the flexible band portion to form a relatively circular orifice that allows a liquid container to be inserted therethrough; and a plurality of substantially spherical members disposed within the housing, the plurality of substantially spherical members configured to be reversibly collapsible within the housing when pressed-on by a user's thumb or finger;

wherein the plurality of substantially spherical members is labeled numerically on each opposing end of the substantially spherical members;

wherein the housing, the flexible band portion and the plurality of substantially spherical members are integrally formed to create a single, contiguous unit.

2. A method for tracking liquid consumption, the method comprising:

providing the liquid consumption tracking device of claim 1;

placing the liquid consumption tracking device around a liquid container;

filling the liquid container with liquid;

pressing one of the plurality of substantially spherical members disposed on an exterior surface of the device each time the liquid container is refilled;

removing the liquid consumption tracking device from the liquid container once all of the substantially spherical members are pressed-in;

inverting the liquid consumption tracking device such that a surface of the device that previously faced the liquid container becomes outwardly facing and an opposite surface is placed against the container; and continuing to refill the liquid container and track liquid consumption by pressing one of the plurality of substantially spherical members each time the liquid container is refilled.

* * * * *